US007468658B2

(12) United States Patent
Bouressa

(10) Patent No.: US 7,468,658 B2
(45) Date of Patent: Dec. 23, 2008

(54) EMERGENCY INGRESS/EGRESS MONITORING SYSTEM

(76) Inventor: Don L. Bouressa, 212 Cotton Bay Way, Simpsonville, SC (US) 29681

( * ) Notice: Subject to any disclaimer, the term of this patent is extended or adjusted under 35 U.S.C. 154(b) by 557 days.

(21) Appl. No.: 10/719,719

(22) Filed: Nov. 21, 2003

(65) Prior Publication Data

US 2004/0140899 A1 Jul. 22, 2004

Related U.S. Application Data

(60) Provisional application No. 60/440,194, filed on Jan. 15, 2003.

(51) Int. Cl.
*G08B 1/08* (2006.01)

(52) U.S. Cl. ..... 340/539.1; 340/539.11; 340/539.13; 340/825.36; 340/825.49

(58) Field of Classification Search ..... 340/539.1, 340/539.11, 539.13, 539.21, 539.23, 539.32, 340/825.36, 825.49
See application file for complete search history.

(56) References Cited

U.S. PATENT DOCUMENTS

| | | | | |
|---|---|---|---|---|
| 4,538,056 | A * | 8/1985 | Young et al. | 235/377 |
| 5,218,344 | A * | 6/1993 | Ricketts | 340/573.4 |
| 5,633,621 | A | 5/1997 | McDonald | |
| 5,960,085 | A | 9/1999 | de la Huerga | |
| 6,211,781 | B1 | 4/2001 | McDonald | |
| 6,348,860 | B1 | 2/2002 | Davis et al. | |
| 6,356,841 | B1 | 3/2002 | Hamrick et al. | |
| 7,019,644 | B2 * | 3/2006 | Barrie | 340/539.13 |

* cited by examiner

*Primary Examiner*—Daryl C Pope
(74) *Attorney, Agent, or Firm*—Leigh P Gregory

(57) ABSTRACT

A system to monitor the entry and exit of individuals from a facility and to identify individuals who have entered the facility and not indicated safe departure from the facility by reporting to an emergency reporting area and activating the system with an identification card. The system also indicates the most likely area of a facility in which an individual may be found. Such census information is made available to emergency workers and is of significant value in rescue efforts following facility evacuations. A modification of the systems allows an attendant to monitor the entry, exit, and re-entry of individuals traveling in two or more vehicles following stops.

16 Claims, 3 Drawing Sheets

EMERGENCY INGRESS/EGRESS MONITORING SYSTEM

This patent application claims the benefit and priority of U.S. Provisional Patent application 60/440,194 filed Jan. 15, 2003, which application is hereby incorporated by reference in its entirety.

FIELD OF THE INVENTION

The present invention relates to a communication system and method to monitor the ingress and egress of individuals to and from various types of facilities, including, but not limited to business and professional offices, schools, hospitals and extended care facilities, and similar structures subject to evacuation under emergency conditions and to monitor ingress/egress for certain types of vehicles and some vessels. It further provides emergency workers with information as to the most likely location of individuals not having evacuated the facility. In addition it provides a means to identify individuals who may need special assistance in the event of an emergency evacuation.

BACKGROUND OF THE INVENTION

The sheer physical size and complexity of many facilities (office buildings, factories, hospitals, and schools, for example) coupled with increasing awareness of the possibility of an emergency evacuation from such facilities suggests the benefits of a simple system to monitor occupancy of the facility, including visitors, such that emergency workers can determine rapidly the completeness of evacuation, identify individuals presumably remaining in the facility, and have a reasonable indication of the location in the building where an individual normally would be located. In non-emergency situations, such a system provides a census of occupancy, and for vehicles, such as school busses, the system indicates individuals boarding and exiting the vehicle, and re-boarding after stops, such as after a field trip. Such monitoring systems improve safety of occupants, enhance the efficiency and safety of emergency workers, and simplify certain supervisory responsibilities of organizations with in loco parentis responsibilities.

Wireless technology has been used to track/locate units from a central office. U.S. Pat. No. 6,356,841 issued Mar. 12, 2002 to Hamrick and Ingman describes and claims a system whereby global positioning system receivers located in vehicles communicate with a central office computer to indicate the location of the vehicle and data related to the operation of the vehicle. The '841 system also allows an office supervisor to determine whether the vehicle has departed from a pre-scheduled route and to communicate with the vehicle operator.

Wireless means have been described to assist in the evacuation of non-ambulatory individuals from a fixed structure. U.S. Pat. No. 5,633,621 issued May 27, 1997 to McDonald describes a system whereby a non-ambulatory individual may enter confidential information including name, destination in the facility, and the nature or extent of disability into a building monitoring system. In the event of an emergency, rescue workers may access the confidential information and determine the location of individuals that may require special assistance. The '621 patent does not suggest how successful evacuation would be monitored to minimize the risks faced by independent emergency workers returning to a location searching for an individual that in fact had safely been evacuated from the facility.

U.S. Pat. No. 6,348,860 issued Feb. 19, 2002 to Davis and Shock describes an evacuation monitoring system in which evacuation wardens visually inspect designated areas and evacuation routes from a given area and activate a reporting system at a remote location to indicate the status of each inspected area. The system allows the evacuation warden to call for specific assistance as needed to accomplish the evacuation successfully.

Tag tracking affords an additional means to track articles, including individuals using moderately sophisticated electronic technology that appears to be less than practical to monitor evacuations from large facilities. U.S. Pat. No. 6,211,781 issued Apr. 3, 2001 to McDonald describes a device and method of tracking articles within a facility using electronic signals. Each article includes a tag that functions as a micro-transmitter/receiver. Tag readers throughout the facility identify each tag within their range and the location of the article is readily determined. This article tracking technology could be useful in tracking the movement of individuals in and around secured areas of a facility, but complexity, range limitations, and potential expense all argue against its general use to monitor evacuations from large facilities. Tag tracking systems are in commercial use to minimize removal of merchandize from retail outlets.

U.S. Pat. No. 5,960,085 describes a system whereby personal identification badges may be used to access computers, including patient data stored in certain types of patient care equipment in health care/delivery facilities. The widely recognized patient identification wrist bracelet may be integrated to ensure that only confidential information related to an identified patient is displayed. Both the identification badge and bracelet could be modified to provide a basis for monitoring the location of individuals in a health care facility. However, the '085 patent does not suggest this application.

Various public safety officers, police and fire fighters carry personal, wireless communications devices for safety and efficiency. Certain commercially available devices are designed to warn emergency workers of hazards or to order evacuation of rescue workers from an area or facility. Some devices also include the capacity to transmit requests for assistance. Such devices generally communicate to a designated "command center." Practical considerations limit the value of such technologies with respect to large, diverse facilities.

Thus, there remains room and need for the development of a wireless system to monitor ingress/egress of facilities, to provide emergency workers current data as to areas in a facility under emergency conditions, and to search for those who have not evacuated the facility. There remains additional need for development of a system to assist supervisors in monitoring ingress/egress and subsequent ingress of individuals to vehicles transporting groups of individuals.

SUMMARY OF THE INVENTION

Protecting human life is the primary objective of emergency rescue workers. Protecting property is a secondary, but important objective. The monitoring system of this invention increases both the efficiency and effectiveness of emergency workers' efforts to protect human life. The monitoring system provides information essential to decisions regarding diverting rescue resources from the primary objective to addressing the secondary objective; thus, the system indirectly also contributes to property protection.

A purpose of the invention is a communication system to monitor the ingress of employees and others to a facility and in the event of an emergency evacuation of the facility, by wired, or preferably by wireless means to monitor and record the safe evacuation (egress) and location of individuals from the facility to an emergency assembly area.

A further purpose of the invention is to rapidly identify individuals whose entry into the facility has been recorded, but, for whom no record of safe exit has been made and to indicate to emergency workers the most likely location in the facility to find the individual.

A related purpose of the invention is enhance safety and security of a facility by monitoring entry into the facility and departure from the facility.

An additional purpose of the invention is to monitor and record the identification, entry, and destination of visitors to the facility for security reasons as well as for monitoring an emergency evacuation from the facility so as to identify individuals remaining in a facility and their most probable location so that efficient use may be made of emergency personnel.

Another purpose of the invention is to provide to rescue workers by electronic means diagrams of structures from which the location of trapped individuals can be high-lighted and evacuation routes and alternatives can be planned at the site of an emergency, but safely away from immediate danger.

Still further, a purpose of the invention is to provide a system to monitor the ingress/egress of hospitals/nursing home patients and visitors such that failure to report safe egress to a designated emergency assemble areas will be immediately recognized and rescue actions promptly initiated.

Regardless of the specific application of the invention, an additional purpose of the invention is flexibility and simplicity of growth or expansion of the system in response to facility growth and increased complexity.

And yet another purpose of the invention is to provide a mobile or portable system to assist supervisors acting potentially for an institution in loco parentis in monitoring ingress of individuals to one or more vehicles, subsequent egress of individuals at the site of an activity, and reentry to any one of the vehicles for return to the school or other facility.

A further purpose of the system is to monitor the evacuation of relatively large numbers of individuals grouped in a confined area, such as passengers reporting to rescue or life boat stations on a cruise ship. Magnetic cards used as room keys could be used as the means to indicate the presence of the occupants of a given room at an assembly site.

These and other goals and purposes of the invention are achieved by an evacuation monitoring system wherein first card reader means at general points of entry communicate ingress/egress data, including the destination of individuals entering the facility to a base computer that maintains the census of facility occupants and their destination or location in the facility such that when the evacuation system is activated by an alarm or by a power outage, the base computer and all other components of the system switch to independent power supplies and the egress data including probable location data are communicated by wireless means to a second, portable computer which is connected by wireless means to at least one second card reader means located at a designated emergency assembly area and which transmits by wireless means presence of an individual at the assembly area by reading a card identifying the individual, thereby allowing the portable computer to generate and provide to emergency workers a list of individuals remaining in the facility and provide a probable location for each, and in addition, at the onset of emergency operations, a wireless transmitter unit associated with the first card reader means is activated such that the first card reader means communicates with the portable computer so that individuals whose egress is entered by way of this unit are also deleted from the occupancy census record, and finally, also by a system associated with a facility comprising one or more elements with a card reader device in each of one or more elements of the facility from which entry, exit, and subsequent re-entry is monitored by the specific reader device associated with each element of the facility in which an element of the facility is one of a group of vehicles, and further in which each card reader device communicates entry, exit, and re-entry data to a computer, wherein the computer is capable of producing an immediate record of all individuals initially entering any element of the facility, exiting an element of the facility, and warning an attendant if all individuals exiting an element of the facility have not re-entered some element of the facility.

BRIEF DESCRIPTION OF THE FIGURES

The numerous purposes, applications, and advantages of the present invention may be better and more clearly understood by reference to the following figures in which reference numbers regardless of the figure in which they might appear, refer to the same part or feature as the reference number initially is used and in which.

DESCRIPTION OF THE PREFERRED EMBODIMENTS

Figure 1:
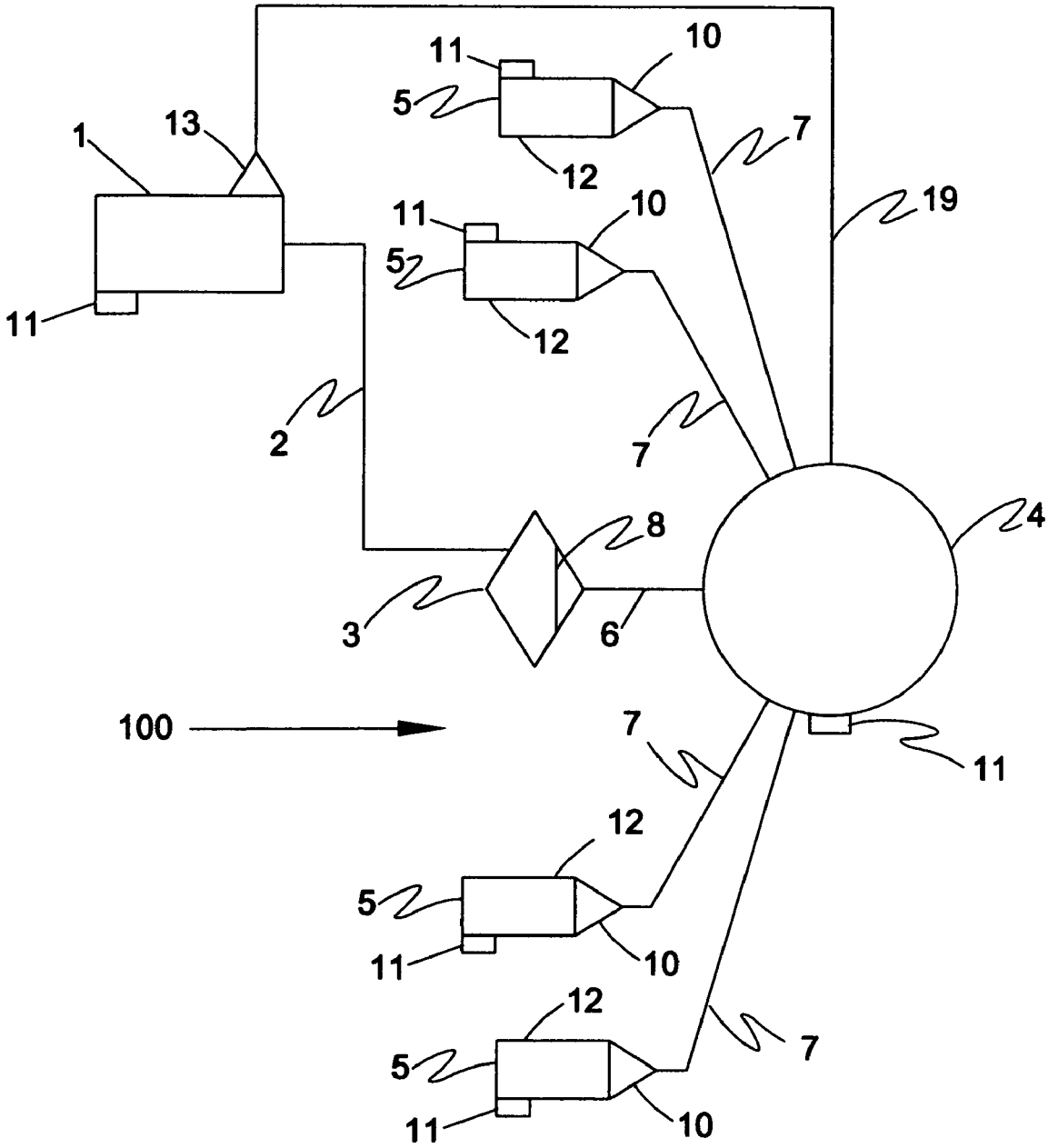
FIG. 1 is a schematic diagram of a communication system to monitor ingress and egress to and from a facility in which ingress and egress data from a first card reader means are communicated to a base computer which is capable of wireless communication with a portable computer, and the portable computer is in wireless communication with at least one second card reader means.

The emergency ingress/egress monitoring system 1 is well adapted to facilities with designated offices or work stations and most individuals located at a specific, designated location or work station. Such facilities include by way of example, but not limitation, business and professional office buildings, hospitals and nursing homes, schools, and certain types of factories and manufacturing facilities, as well as monitoring passengers leaving and returning to bus, train, aircraft, or vessel and individuals reporting to emergency or evacuation centers or shelters.

The emergency ingress/egress monitoring system regardless of any specific application or adaptation requires a source of personal identification capable of being read by a card reader means located at the point of ingress, a base computer and a means, preferably wireless, to communicate the individual data to a base computer, a portable computer in, preferably, wireless communication with the base computer, and a second card reader means, in preferably wireless, communication to input personal identification data to the portable computer. Input of personal data to the base computer indicates ingress to a facility, and input to the portable computer in the event of an emergency indicates egress from the facility and the location of the individual.

Many commonly used items may be adapted to serve as the required source of personal information data. Examples include, but are not limited to magnetic strips on employee identification cards, bar codes on identification cards, or separate cards, and magnetic room keys with specific identification information. The means to read any of these include a plurality of forms of the common card "swipe readers" or parallel devices that read magnetic keys. The invention also anticipate more sophisticated means of personal recognition/personal data entry including voice recognition and recognition of physical traits.

The source of personal data may include minimum information such as a specific name or identification number, with other data independently stored in the base computer and automatically referenced by the name, or the individual, personal data input may include all information essential for rescuers, such as office or general duty station in the facility and the need, if any, for special assistance.

The system also includes capabilities to monitor guests or visitors to the facility. Although current technology may limit applications of the more sophisticated voice or optical identification systems to regulate employees, at least minimum personal data can be secured from visitors, encoded on most swipe card devices and thus used in the system. The invention anticipates that data for guest would include information that would automatically indicate the most likely location of the visitor in the event of an emergency. This is readily accomplished by either indicating the individual with whom the visitor will be meeting and using the hosts most likely location as that for the visitor, or by indicating the location in the facility the guest will visit.

EXAMPLE 1

Consider as a first example illustrated by FIG. 1, the emergency ingress/egress monitoring system 100 adapted to a large building with a large number of individuals, most of whom have a well defined work site. The minimum personal data for each employee is encoded in a magnetic strip on the employees identification card. All employees enter their personal data by passing their identification card through one of a plurality of first card reader means 1. The identification card includes at least the name and designated work station or office of the employee. The data are communicated to a base computer 3 that is in operational communication 2 with the first card reader means 1. Under normal conditions, the base computer 3 maintains a running census of individuals that enter the facility and removes the individual from the census when the individual exits the facility. The departure of an individual is monitored in a manner comparable to the entry monitoring with the use of the identification card removing the individual from the census of current occupants of the facility. Operational communication 2 between the first card reader means 1 and base computer 3 in the facility is most commonly and preferably by hard wire linkage. The invention anticipates wireless means as an acceptable alternative. In an expanded version of the system, the operational communication 2 between the first card reader means 1 and base computer 3 includes both the preferred hard wire and wireless means as an alternative in the event of damage to the wire linkage.

In the event of an evacuation of the building, power failure, or similar emergency, the base computer 3 by wireless transmitter means 8 transmits 6 the current facility census occupancy data to a portable computer 4 located at a secure, remote site. The portable computer 4 communicates, preferably by wireless 7 means with a plurality of second card reader means 5 located at designated emergency assembly areas. Communication between the portable computer 4 and second card reader means 5 at permanently established emergency assembly areas may be by wired means. Maximum flexibility is maintained when the communication between the portable computer 4 and second card reader means reader is by wireless means. Each second card reader means 5 comprises a card reader element 12, an independent power supply element 11, and a wireless or hard wired communication element 10 capable of transmitting egress data entered into the reader element 12 to the portable computer 4.

The portable computer 4 has the capability to display and to produce (print) hard copies of both census data and graphic diagrams or plans of the facilities and similar materials. This information may be vital in rescue operations and in determining when rescue resources may be diverted from life saving/rescue activities to protecting property. The data, among other information, may provide critical information as to fully evacuated areas, areas with extreme hazards, and to locations of individuals that might require special assistance to evacuate the facility.

Employees evacuating the facility are directed to any of the emergency assembly areas at which employees indicate safe egress from the facility by passing their identification card through a second card reader means 5. The census data maintained by the portable computer 4 are adjusted such that at any time a list of those individuals that have not been safely evacuated from the facility can be produced for emergency workers. When the system is activated by a power outage or physical activation calling for emergency, independent power supply elements 11 on the base computer, portable computer 4, first card reader means 1 and second card reader means 5 are activated. In addition, a wireless transmitter device 13 establishes a communication link 19 between the portable computer 4 and the first card reader means 1 so that egress data entered at the second card reader means are included in the census data of the portable computer 4, thereby ensuring that all individuals safely evacuated from the facility including those that may egress by a normal entry and record their exit in the normal manner are deleted from the facility census for rescue purposes.

In one configuration of this example, the portable computer is adapted to receive egress data input by telephone such that an individual who had safely evacuated the facility but had not otherwise recorded his exit can do so by using any telephone instrument with digital capabilities and contacting a preestablished emergency number that accesses the portable computer. The portable computer is programmed to receive such telephone delivery of egress data and adjust the building census accordingly. The egress record of the individual may even include a notation that the individual reported from a remote site, not from a designated evacuation area.

The census data retained by the portable computer 4 include the location at which individuals not indicated as having been safely evacuated are most likely to be found. In addition, depending solely on the extent of the data entered initially, the census data may also provide information regarding special assistance an individual may require in evacuating the facility.

In an expanded model of the system, a schematic representation of the floor plan of the facility, for each floor or level is included as basic data in the base computer or programmed into the portable computer. When data indicate an individual has not exited the facility in an emergency, in addition to identifying the individual and the most probable location of the individual in the facility, a computer printout includes the appropriate schematic of the facility showing emergency workers the most probable or anticipated location of the individual, routes to that location, and related emergency information.

To ensure that the independent power supplies to the second computer and to the second card reader means units are maintained, each unit may be linked to an independent power supply element that may be solar driven or a battery based solar based power supply/charging unit (not illustrated). The independent power supply element 11 serving the base computer 1 and first card reader means are charged preferably by individual drip charger units.

In view of the heightened sense of security in many public facilities or facilities accessible to the public, the system of FIG. 1 is acceptably practical for monitoring visitors and guests to many facilities. In any situation in which the basic elements of FIG. 1 are applied to regular occupants of a facility, steps to monitor guests and visitors employing the same system are relatively simple to implement. A simple application is to provide each visitor with an identification card that merely indicates the presence of an individual in the facility. Name tags would continue to provide on site identification. Simple devices are available to generate temporary identification cards that would require the visitor to provide the same census information provided by employees, including destination within the facility. Such information enhances facility security and helps ensure the visitor maximum assistance in the event of an emergency during the visit.

The system anticipates, but does not require the use of an additional, simple head count means to monitor the gross number of individuals entering and/or leaving a facility through any monitored location. Individuals, either before activating the entry way reader or on entering a specific area of the facility, or both, activate a traffic count device such as a counter associated with an entry turn style or by breaking a light beam. Such devices are passive with respect to required actions by the individual, but add a significant, simple element of security by maintaining a continuous record of the number of individuals entering or remaining in a designated area, from an individual room to an entire facility. Data from such devices are transmitted and processed following the same manner as the previously described methods for card reader devices.

EXAMPLE 2

Figure 2:
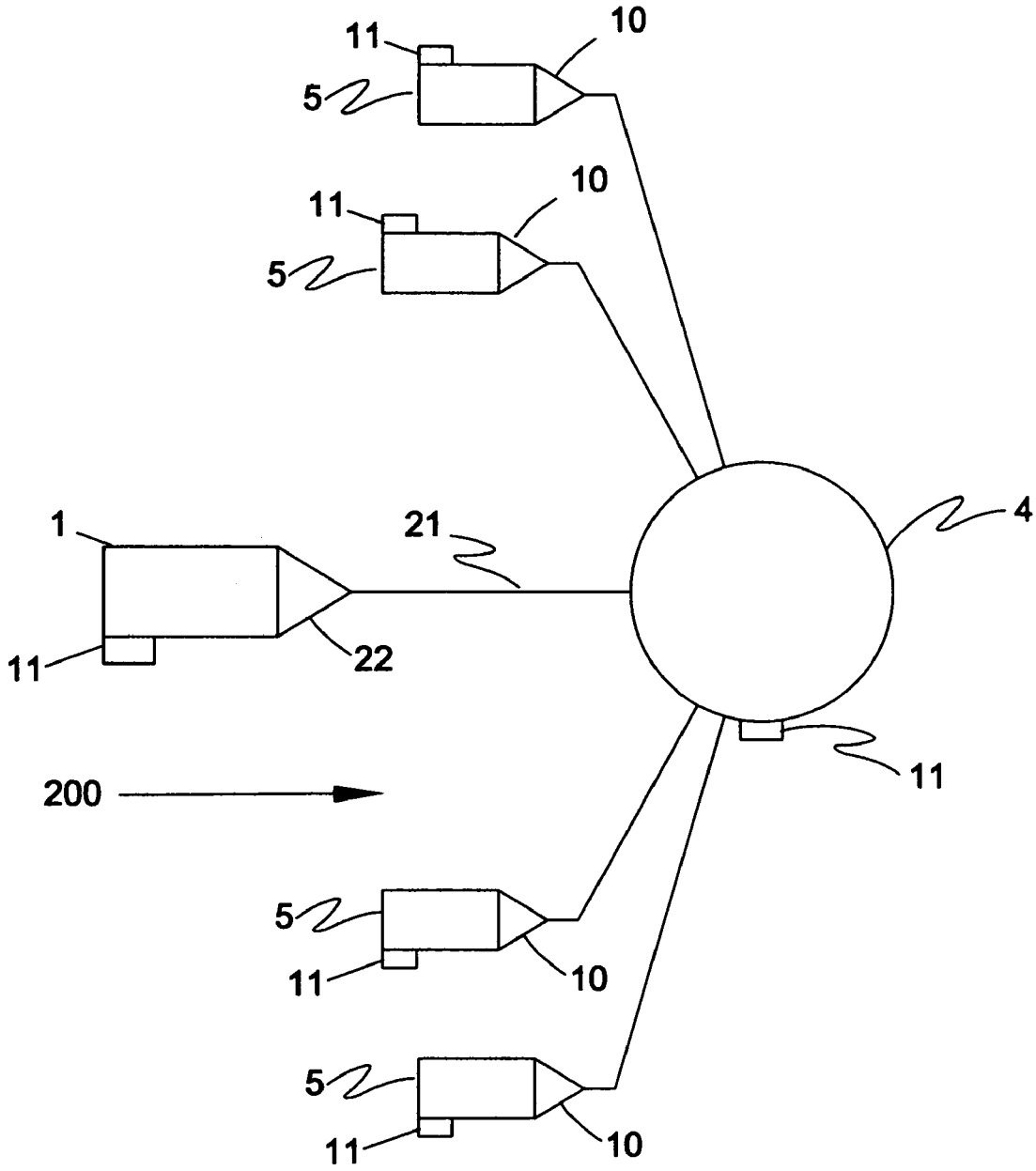
FIG. 2 is a schematic diagram of a communication system to monitor ingress and egress to and from a facility in which ingress data are communicated directly from a first card reader means by wireless means to a portable computer, and the portable computer is in wireless communication with at least one second card reader means.

FIG. 2 illustrates a system 200 that tracks and locates employees and visitors in a facility in a manner similar to the system described in Example 1 and illustrated by FIG. 1. The system 200 of FIG. 2 comprises a basic first card reader means 1. The first card reader transmits personal identification (census) data such as employee name and work location as in Example 1. The first card reader means 1 includes, in addition to its independent power source 11, a wireless transmitter 22 that transmits by wireless means 21 the individual ingress data directly to the portable computer 4. The communication between the portable computer 4 and second card reader means is as described in Example 1. Because the portable computer 4 and first card reader means are active for collection of ingress and egress data, the power source is changed for emergency operations. The second card reader means 5 located at assembly points are activated by actual use of an individual passing an identification card through or against the reader element.

EXAMPLE 3

Figure 3:
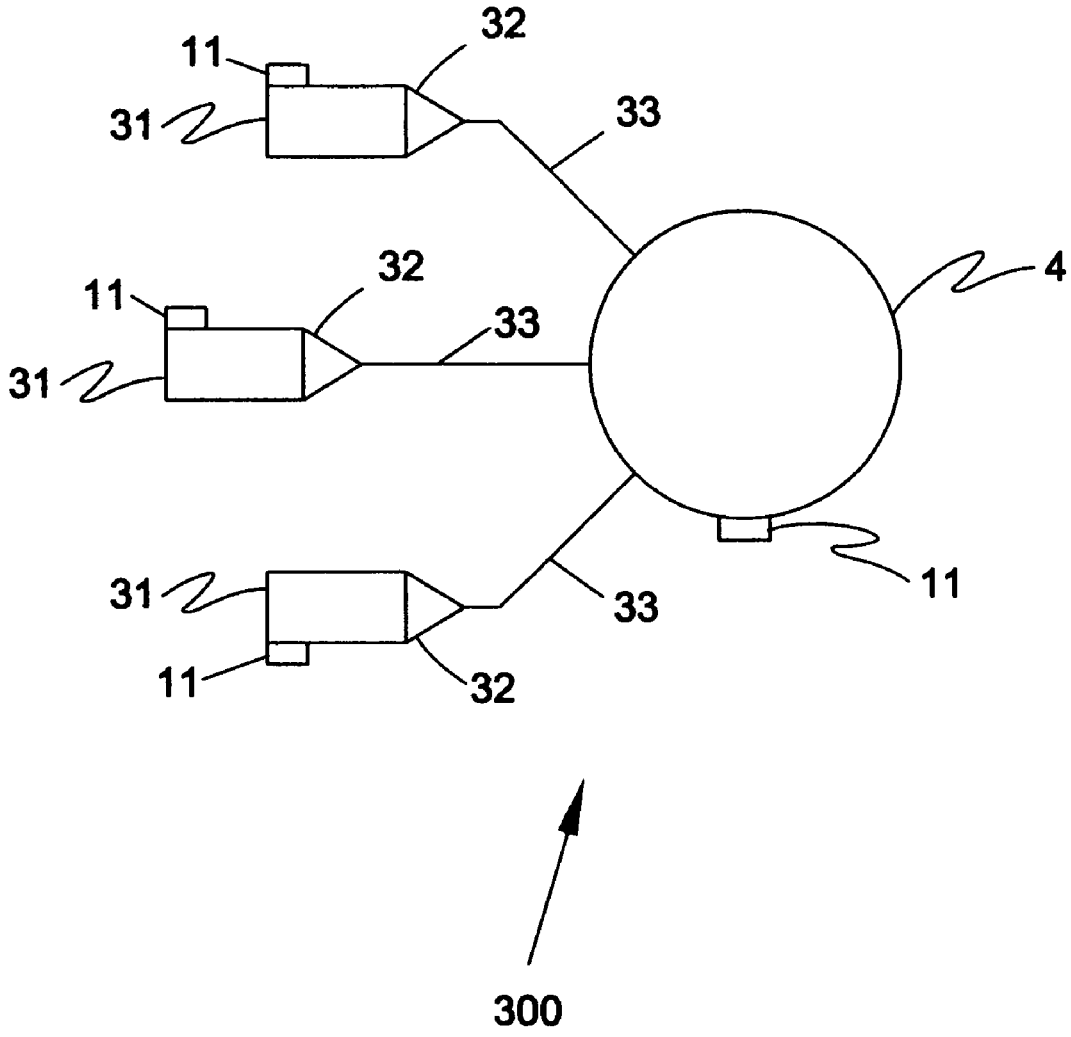
FIG. 3 is a schematic diagram of a communication system to monitor and transmit by wireless means ingress and egress data directly from portable card reader means a portable computer.

FIG. 3 illustrates an alternative system 300 to both Examples 1 and 2 as illustrated respectively by FIG. 1 and FIG. 2. Each card reader unit 31 functions as both an first card reader means and as a second card reader means. A transmitter/receiver unit 32 capable of wireless communication 33 with the portable computer 4 is integrated into the card reader means 31. Each card reader means 31 is supplied with an independent power source 11, and these independent power sources are adapted to being connected to a standard battery charger device (not shown). Both the portable computer 4 and card reader means are portable.

This system finds its most obvious applications in non-emergency situations such as monitoring individuals entering an area, leaving the area, and then re-entering the area wherein it is important to ensure that all individuals that leave the area return. By way of example, but not limitation, the system is applied to monitoring a group of students being transported by more than one vehicle to a location at which they will exit the vehicles for an activity (field trip) and then return to a vehicle.

A card reader unit 31 is provided for each vehicle, and individuals boarding the vehicle are recorded using common card reader technology as previously described. The vehicle census is transmitted to the portable computer 4 by wireless means. The exit of each passenger is recorded by passing the identification card through the reader, as with other systems. When the passengers return, re-boarding is similarly monitored by card reader. In every instance, the census data are transmitted to the portable computer 4. Prior to departing from the area, a final census is generated by the portable computer indicating whether all individuals that originally boarded any vehicle have re-boarded some vehicle. The computer is adapted to sound an audible warning if the egress data and subsequent ingress data do not agree, thereby indicating that at least one individual that exited a vehicle has not boarded any vehicle. If any individual is missing, a physical head count is conducted before a search is initiated. The initial ingress data may include names of passengers so that the warning will include the name of the apparently missing individual. Note as illustrated, the portable computer 4 serves the function of both the base computer and portable computer of previous examples. The system anticipates that a separate base computer can be used and that in this configuration all communications among computers and card readers will be by wireless means.

In many instances, for small children, supervisors will distribute identification cards for specific events and collect them following the event or activity for future use or recycling. Reasonable means are available to produce identification cards for individuals for specific activities.

EXAMPLE 4

The system of example 4 can be expanded for varied situations, including monitoring individuals reporting to emergency sites, such as life boat stations of cruise ships. Magnetic room keys provide the necessary identification of the individual's presence at a site.

The preceding examples all call for and assume that census data will be entered by card reader means. These include both magnetic "swipe" cards and optical scan cards. Although such means are convenient and devices readily available, the invention anticipates data entry by other means, including key pad entry by individuals. Such key pad entry includes entry by telephonic means. The invention also anticipates the use of thumb print recognition technology as a means of providing ingress and egress data. In addition, with respect to the portable computer, the invention anticipates display of census data and list by visual display means and by means of lists printed by a printer device associated with the computer.

Preferred embodiments of the invention have been described using specific terms and devices. The words and terms used are for illustrative purposes only. The words and terms are words and terms of description, rather than of limitation. It is to be understood that changes and variations may be made by those of ordinary skill in the art without departing from the spirit or scope of the invention, which is set forth in the following claims. In addition it should be understood that aspects of the various embodiments may be interchanged in whole or in part. Therefore, the spirit and scope of the appended claims should not be limited to descriptions and examples herein.

What I claim is:

1. An emergency ingress/egress monitoring system for a facility comprising:

a. at least one first card reader means, said first card reader means being in communication with a base computer, said base computer being capable of storing and transmitting ingress and egress data received from said at least one first card reader means;

b. a plurality of second card reader means, said plurality of second card reader means being located at emergency assembly areas outside of the facility and further being capable of wireless communication with a portable computer;

c. said portable computer being located at a remote secure position outside of said facility and further being in communication with said base computer, and said portable computer further being capable of processing, visually displaying, and generating printed displays of census data transmitted from said base computer, wherein individuals entering the facility register their ingress by passing a personal identification card through the at least one first card reader means and wherein, under normal conditions, such individuals upon exiting the facility register their egress by passing their personal identification card through the at least one first card reader means and wherein, under emergency conditions, such individuals upon exiting the facility may register their egress by passing their personal identification cards through one of the plurality of second card reader means, wherein communication between said base computer and said portable computer and processing of ingress data and egress data received by said first card reader means and by said plurality of second card reader means allows the evacuation status of the facility to be accurately determined in real time.

2. The system of claim 1 wherein said portable computer is adapted to communicate with telephone transmitters and to respond to information received via said telephone transmitters, such that individuals exiting the facility may register their egress by calling a predetermined emergency phone number.

3. The system of claim 1 wherein the facility is an office building.

4. The system of claim 1 wherein the facility is an educational facility.

5. The system of claim 1 wherein the facility is a health care facility.

6. The system of claim 1 wherein the facility is a residential care facility.

7. The system of claim 1 wherein the facility comprises at least one vehicle.

8. The system of claim 1 wherein the facility is a ship.

9. The system of claim 1 wherein said portable computer is capable of generating printed images of schematic diagrams of the facility.

10. The system of claim 1 wherein said at least one first card reader means, said base computer, said portable computer, and said plurality of second card reader means each has an independent power supply element each of which said independent power supply elements is automatically activated under emergency conditions, including any power failure.

11. The system of claim 10 wherein said independent power supply element associated with said portable computer and with said plurality of second card reader titans each have solar power panels to recharge said independent power supply elements and said independent power supply elements for said base computer and said at least one first card reader means are charged by drip charge devices.

12. The system of claim 10 wherein said at least one first card reader means communicates directly by wireless means with said portable computer.

13. An emergency ingress/egress monitoring system for a facility comprising:

a. at least one first personal recognition means, said first personal recognition means being in communication with a base computer, said base computer being capable of storing and transmitting ingress and egress data received from said at least one first personal recognition means;

b. a plurality of second personal recognition means, said plurality of second personal recognition means being located at emergency assembly areas outside of the facility and further being capable of wireless communication with a portable computer;

c. said portable computer being located at a remote secure position outside of said facility and further being in communication with said base computer, and said portable computer further being capable of processing, visually displaying, and generating printed displays of census data transmitted from said base computer, wherein individuals entering the facility register their ingress at the at least one first personal recognition means and wherein, under normal conditions, such individuals upon exiting the facility register their egress at the at least one first card reader means and wherein, under emergency conditions, such individuals upon exiting the facility may register their egress at one of the plurality of second personal recognition means, wherein communication between said base computer and said portable computer and processing of ingress data and egress data received by said first personal recognition means and by said plurality of second personal recognition means allows the evacuation status of the facility to be accurately determined in real time.

14. The system of claim 13 wherein the at least one first personal recognition means and the plurality of second personal recognition means comprise optical scanners.

15. The system of claim 13 wherein the at least one first personal recognition means and the plurality of second personal recognition means comprise voice recognition means.

16. The system of claim 13 wherein the at least one first personal recognition means and the plurality of second personal recognition means comprise thumb print recognition means.

* * * * *

UNITED STATES PATENT AND TRADEMARK OFFICE

CERTIFICATE OF CORRECTION

PATENT NO. : 7,468,658 B2
APPLICATION NO. : 10/719719
DATED : December 23, 2008
INVENTOR(S) : Bouressa It is certified that error appears in the above-identified patent and that said Letters Patent is hereby corrected as shown below:

On the Title Page, Item (76) Inventor should read: Don L. Bouressa, 312 Cotton Bay Way, Simpsonville, SC 29681

In the Specification

Column 1, line 57 may should read must
Column 1, line 58 including should read excluding Signed and Sealed this
Sixth Day of January, 2015

Michelle K. Lee

Michelle K. Lee
*Deputy Director of the United States Patent and Trademark Office*